US011505427B2

(12) United States Patent
Karimpanackal Natarajan et al.

(10) Patent No.: US 11,505,427 B2
(45) Date of Patent: Nov. 22, 2022

(54) ELEVATOR WITH A SAFETY ARRANGEMENT AND METHOD FOR CREATING A SAFE WORKING SPACE IN THE UPPER PART OF THE ELEVATOR SHAFT

(71) Applicant: Kone Corporation, Helsinki (FI)

(72) Inventors: Nithil Karimpanackal Natarajan, Helsinki (FI); Markku Haivala, Hyvinkaa (FI); Ari Kattainen, Helsinki (FI)

(73) Assignee: Kone Corporation, Helsinki (FI)

( * ) Notice: Subject to any disclaimer, the term of this patent is extended or adjusted under 35 U.S.C. 154(b) by 1195 days.

(21) Appl. No.: 15/954,122

(22) Filed: Apr. 16, 2018

(65) Prior Publication Data

US 2018/0229966 A1 Aug. 16, 2018

Related U.S. Application Data

(63) Continuation of application No. PCT/FI2015/050722, filed on Oct. 22, 2015.

(51) Int. Cl.
*B66B 5/00* (2006.01)
*B66B 1/32* (2006.01)
(Continued)

(52) U.S. Cl.
CPC ..... *B66B 5/0056* (2013.01); *B66B 1/32* (2013.01); *B66B 1/3407* (2013.01); *B66B 3/002* (2013.01);
(Continued)

(58) Field of Classification Search
CPC ..... B66B 5/0031; B66B 5/0087; B66B 5/005; B66B 5/18; B66B 11/0045; B66B 1/32;
(Continued)

(56) References Cited

U.S. PATENT DOCUMENTS 7,025,177 B1 * 4/2006 Yang ..... B66B 7/027 187/254
2010/0038183 A1 * 2/2010 Henseler ..... B66B 5/0087 187/401
(Continued)

FOREIGN PATENT DOCUMENTS

CN 101151203 A 3/2008
CN 100415625 C 9/2008
(Continued)

OTHER PUBLICATIONS

International Search Report PCT/ISA/210 for International Application No. PCT/FI2015/050722 dated Jan. 26, 2016.
(Continued)

*Primary Examiner* — Marlon T Fletcher
(74) *Attorney, Agent, or Firm* — Harness, Dickey & Pierce, P.L.C.

(57) ABSTRACT

The invention relates to methods and arrangements for creating a safe working space in the upper part of an elevator shaft. A position of an elevator car in the elevator shaft in relation to a plurality of safety levels in the elevator shaft may be monitored, where each safety level is associated with a separate clearance of the elevator car from a ceiling of the elevator shaft. The elevator may be controlled to create a safety space zone at the upper part of the elevator shaft. The controlling may include progressively activating separate braking systems in response to the elevator car progressively moving upwards through separate triggering limits of separate clearances, to progressively strengthen an arresting of upwards movement of the elevator car through the elevator shaft.

10 Claims, 4 Drawing Sheets

Figure 1:
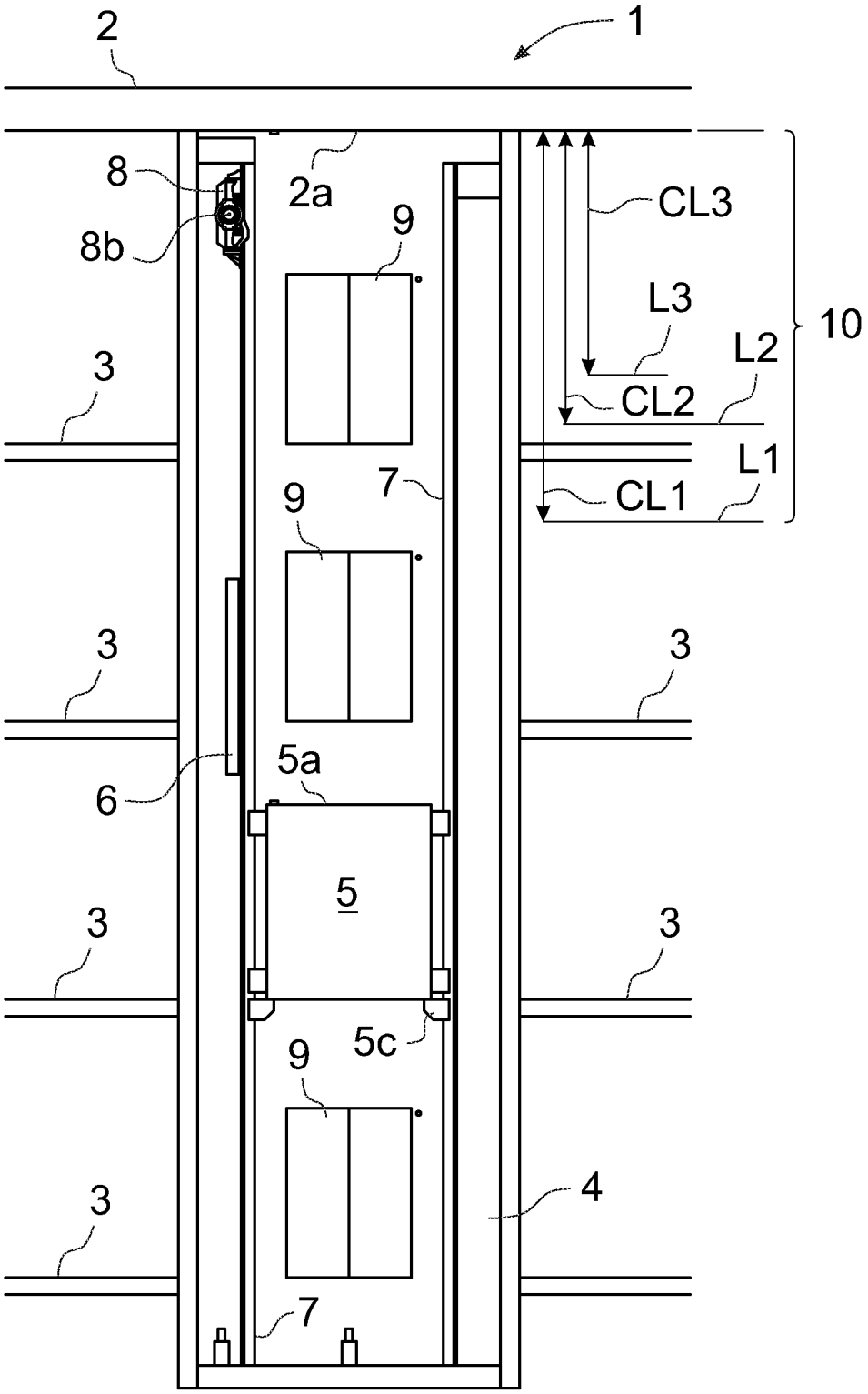

(51) Int. Cl.
*B66B 1/34* (2006.01)
*B66B 3/00* (2006.01)
*B66B 9/00* (2006.01)

(52) U.S. Cl.
CPC ..... *B66B 5/0068* (2013.01); *B66B 9/00* (2013.01); *B66B 2201/00* (2013.01)

(58) Field of Classification Search
CPC . B66B 5/0018; B66B 5/0025; B66B 11/0246; B66B 5/0056
See application file for complete search history.

(56) References Cited

U.S. PATENT DOCUMENTS

2010/0155184 A1* 6/2010 Sirigu ..... B66B 5/0081 187/314
2010/0163346 A1* 7/2010 Coquerelle ..... B66B 13/22 187/351
2010/0252369 A1* 10/2010 Tolonen ..... B66B 5/0056 187/379
2011/0168500 A1* 7/2011 Rossignol ..... B66B 9/00 187/406
2011/0240413 A1* 10/2011 Madar ..... B66B 5/0056 187/343
2015/0336768 A1* 11/2015 Otsuka ..... B66B 1/3492 187/394
2018/0118513 A1* 5/2018 Fauconnet ..... B66B 5/0031
2018/0229966 A1* 8/2018 Karimpanackal Natarajan ..... B66B 9/00
2019/0112158 A1* 4/2019 Haapaniemi ..... B66B 5/005
2019/0119072 A1* 4/2019 Haapaniemi ..... B66B 11/0246
2019/0119073 A1* 4/2019 Haapaniemi ..... B66B 11/0246
2019/0119074 A1* 4/2019 Haapaniemi ..... B66B 5/005
2019/0135586 A1* 5/2019 Haapaniemi ..... B66B 1/3415
2020/0122963 A1* 4/2020 Pahlke ..... B66B 1/3492

FOREIGN PATENT DOCUMENTS

EP 1602610 A1 12/2005
JP 2002114462 A 4/2002
JP 2015034076 A 2/2015
JP 5743346 B2 7/2015
WO WO-2006082275 A2 8/2006

OTHER PUBLICATIONS

Written Opinion of the International Searching Authority PCT/ISA/237 for International Application No. PCT/FI2015/050722 dated Jan. 26, 2016.
Chinese Office Action dated Jan. 31, 2019 for corresponding Chinese Application No. 201580084078.9.

* cited by examiner

ELEVATOR WITH A SAFETY ARRANGEMENT AND METHOD FOR CREATING A SAFE WORKING SPACE IN THE UPPER PART OF THE ELEVATOR SHAFT

This application is a continuation of PCT International Application No. PCT/FI2015/050722 which has an International filing date of Oct. 22, 2015, the entire contents of which are incorporated herein by reference The present invention relates to an elevator with a safety arrangement as defined in the preamble of claim 1 and a method as defined in the preamble of claim 8 for creating a safe working space in the upper part of the elevator shaft.

Various tasks, such as inspections, adjustment works, maintenance or repairs are often performed in the elevator shaft on the roof of the elevator car. In that case the safety of the persons working in the elevator shaft has always to be secured. If the height of the top clearance of the elevator shaft is shallow, a sufficient safety space, which prevents injuries occurring for persons working on the roof of the elevator car, cannot always be guaranteed without special procedures.

In the case mentioned above an unintentional movement of the elevator car must be prevented in some other way than by the regular operating brakes of the elevator. It is known in the prior art that this kind of prevention can be done by locking the elevator car and/or the counterweight into their positions on the guide rail, for instance by means of a safety gear, a latch or wedges. However, this often requires that the working persons must separately go to the elevator shaft and perform the locking. That makes safety preparation tasks awkward, laborious and time-consuming.

Another known solution is to fix a rope clamp to the hoisting roping, by means of which rope clamp the hoisting roping is bound fast to e.g. the overhead beam of the shaft. This is also, however, an awkward and time-consuming solution and requires special tools.

Yet another solution according to prior art for achieving an adequate safety space in the upper part of an elevator shaft is to use one or more turnable buffers that are disposed below the counterweight. The buffer is lifted upright before going onto the roof of the elevator car to work. The length of the buffer is such that the movement of the counterweight, and at the same time the movement of the elevator car, stops before the elevator car rises too high with respect to the ceiling of the elevator shaft. One problem, among others, in this solution is, however, that the shaft space might have been dimensioned so precisely that there is no proper space in the bottom part of the elevator shaft for a turnable buffer. Another problem is that the aforementioned buffer ensuring the top safety space is in the bottom part of the elevator shaft, i.e. right at the other end of the elevator shaft. In that case installing the buffer into the safe position takes extra time and it may also happen that for this reason the person in charge does not remember to go down to the bottom of the elevator shaft to turn them into the safe position.

In addition to the aforementioned, the safety solutions are often based on electrical supervision controls installed in the doors of the shaft, which controls must be switched to the safe position before going onto the roof of the elevator car. Turning the buffers into the safe position and activation of the electrical control circuits are often such a complex combination that, particularly e.g. with small tasks, they might be left undone owing to their complexity and for saving the time used. In addition, electrical supervision control systems are susceptible to failure.

Yet one solution according to the prior art is shown in the US patent publication No. US2010/0200339 A1. The solution according to the US publication presents an elevator safety system for elevators with a reduced upper end of the elevator shaft. In this arrangement the roof of the elevator car is constructed so that it does not support loads. Thus, it is not possible to walk on the roof of the elevator car. In this case the required free safety space is formed completely inside the elevator car when the elevator car is in its uppermost position. When a force caused by a load is directed towards the roof of the elevator car it yields as the result of deformation or the roof is lowered downwards. The maintenance work at the top part of the elevator shaft is done inside the elevator car. For this purpose a part of the sidewall of the car is made removable and the maintenance work is done though the opening in the sidewall when the part mentioned above has been removed from the sidewall. However, the problem in this solution is the fact that there are only limited possibilities to make inspection, repair and maintenance work because only one certain opening is used. And likewise there are limited possibilities to place elevator appliances that require regular maintenance in the elevator shaft because the opening is only at one sidewall of the car. In addition the opening makes the wall structure more expensive, more complicated and also weaker than the unbroken wall structure.

One object of the present invention is to eliminate drawbacks of prior art technology and to achieve an elevator with a safety arrangement, wherein the safety arrangement is operationally extremely reliable, easy and fast to use and surely guarantees a required safety space regardless of a possible carelessness or ignorance of the persons performing the tasks in the elevator shaft, and wherein the interception of the movement of the elevator car is implemented automatically and progressively strengthening without separate complex and time-consuming procedures. The elevator, according to the invention, with a safety arrangement is characterized by what is disclosed in the characterization part of claim 1. Correspondingly, the method for creating a safe working space in the upper part of the shaft of the elevator is characterized by what is disclosed in the characterization part of claim 8. And other embodiments of the invention are characterized by what is disclosed in the other claims.

The invention makes it possible to achieve advantageous and reliable ways for providing a safety space above the elevator car. Preferably the safety space to be formed by means of the invention is applicable to and sufficient for performing maintenance and repair tasks and other procedures to be carried out in the elevator shaft from the roof of the elevator car. Preferably the invention is expressed as an elevator with a safety arrangement for creating a safe working space in the upper part of an elevator shaft equipped with a ceiling, a bottom and side walls, which elevator comprises at least an elevator operating system, control system and a safety system, and an elevator car arranged to run in the elevator shaft along guide rails, a counterweight connected to the elevator car with hoisting ropes from above, a hoisting machinery in the upper part of the elevator shaft with operating brakes, and at least an arrangement to monitor the position of the elevator car in the elevator shaft. The safety arrangement of the elevator comprises a number of safety levels with pre-defined clearances and triggering limits for safety operations in order to create a safety space at the upper part of the elevator shaft by stopping progressively strengthening the upwards movement of the elevator car for the elevator being in an inspection or maintenance mode. That means that the upwards movement of the elevator car is stopped, when the elevator is in the inspection or maintenance mode, with actions which are arranged to become more and more effective and definitive safety level by safety level. Some inventive embodiments are also discussed in the descriptive section of the present application.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

An aspect and an advantage of the invention is to provide a way to use in an elevator design an existing way to detect a presence of a person on the car roof or in the top part of the elevator shaft. Instead or supplementing the existing way to detect presence of a person other means for this purpose can be used, for example an infrared sensor can be installed in the top part of the elevator shaft to monitor the shaft space above the highest position of the elevator car. The detection of the presence of the person may be direct one, for example based on a suitable sensor, or indirect one, for example a conclusion based on the opening of the landing door at the top floor and on the elevator car position near the top floor so that the car roof can be accessed from the top floor.

One advantage of the invention is that invention enables a safe way of providing an elevator that has an extremely shallow top clearance. The top clearance can even be minimized to the minimum, or close to the minimum, required by only the trajectory of the elevator car. Thus when the elevator car is in its uppermost possible position on its trajectory, the shaft space above the elevator car is small and the height of the elevator shaft can easily be fitted inside the building, without penetrating the roof of the building. Another advantage of the solution according to the invention is that an unintended movement of the elevator car can be effectively, reliably and safely prevented. Yet another advantage is that the solution is very easy and quick to use, and does require neither awkward working in the elevator shaft nor preliminary procedures at the top end or bottom end of the elevator shaft. Yet another advantage is the improvement in safety compared to conventional solutions, because the progressively strengthening prevention of the unintended movement of the elevator car switches on automatically when stepping onto the roof of the elevator car or when actuating other actuators automatically. In this case situations cannot arise where switching the safety circuit on would be forgotten, or where a person could not be bothered to switch it on because of its complexity, e.g. for a short job to be performed on the roof. Yet another advantage is that the solution according to the invention also enables types of elevator applications that, for some reason, lack natural top clearances. A further advantage is that the apparatus comprised in the arrangement takes little space. Yet a further advantage is also that the solution is inexpensive and simple to implement. The method according to the invention has several useful advantages. Among other things it makes it possible to automatically create the required safety space. Thus the creation of the safety space can never be forgotten.

Figure 2:
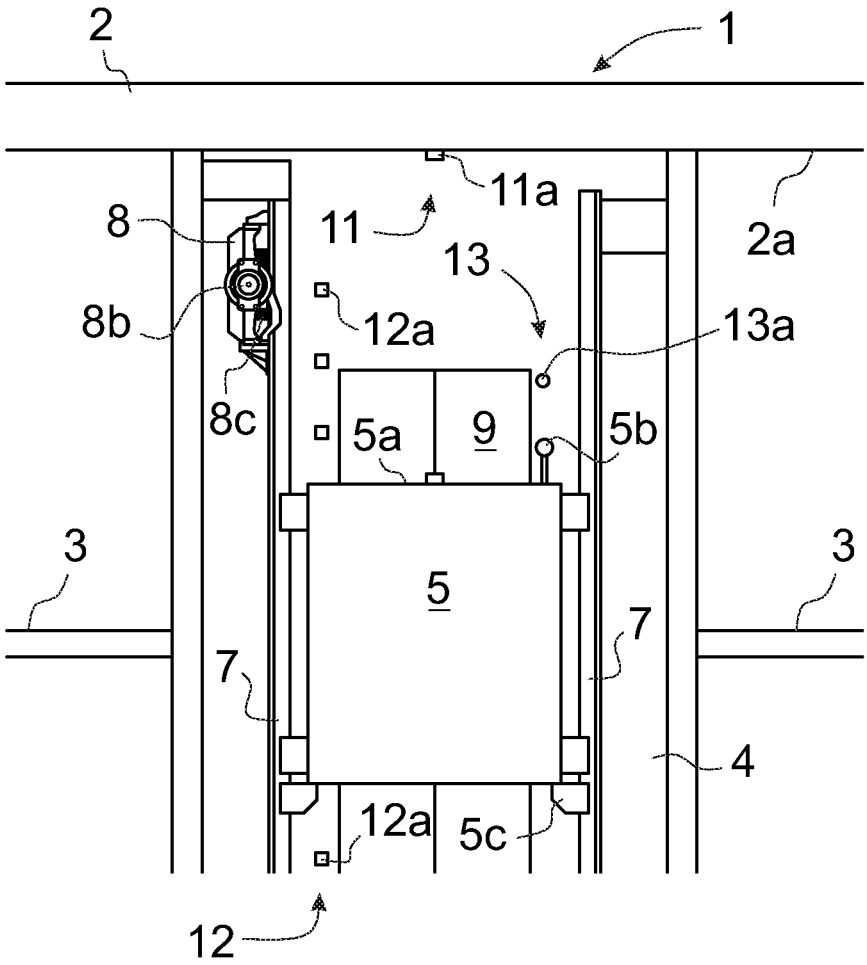
Figure 3:
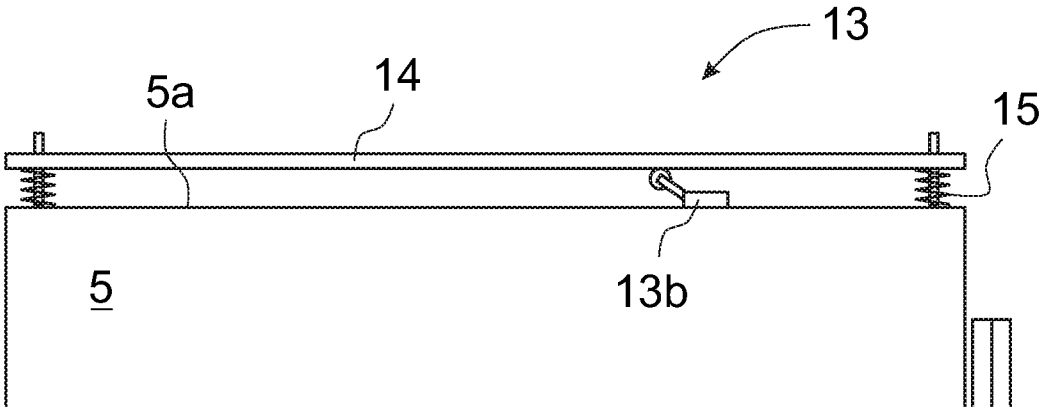
Figure 4:
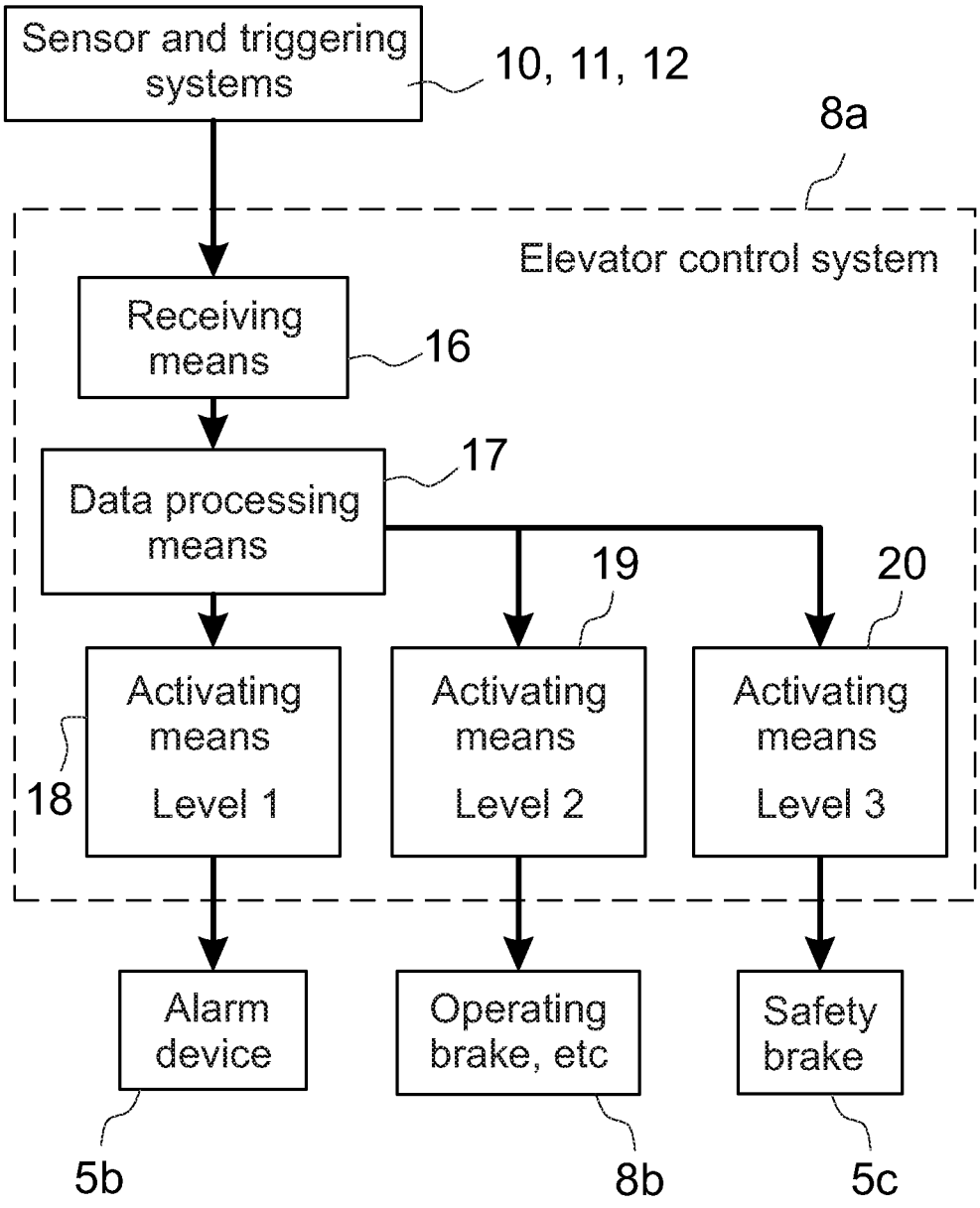
Figure 5:
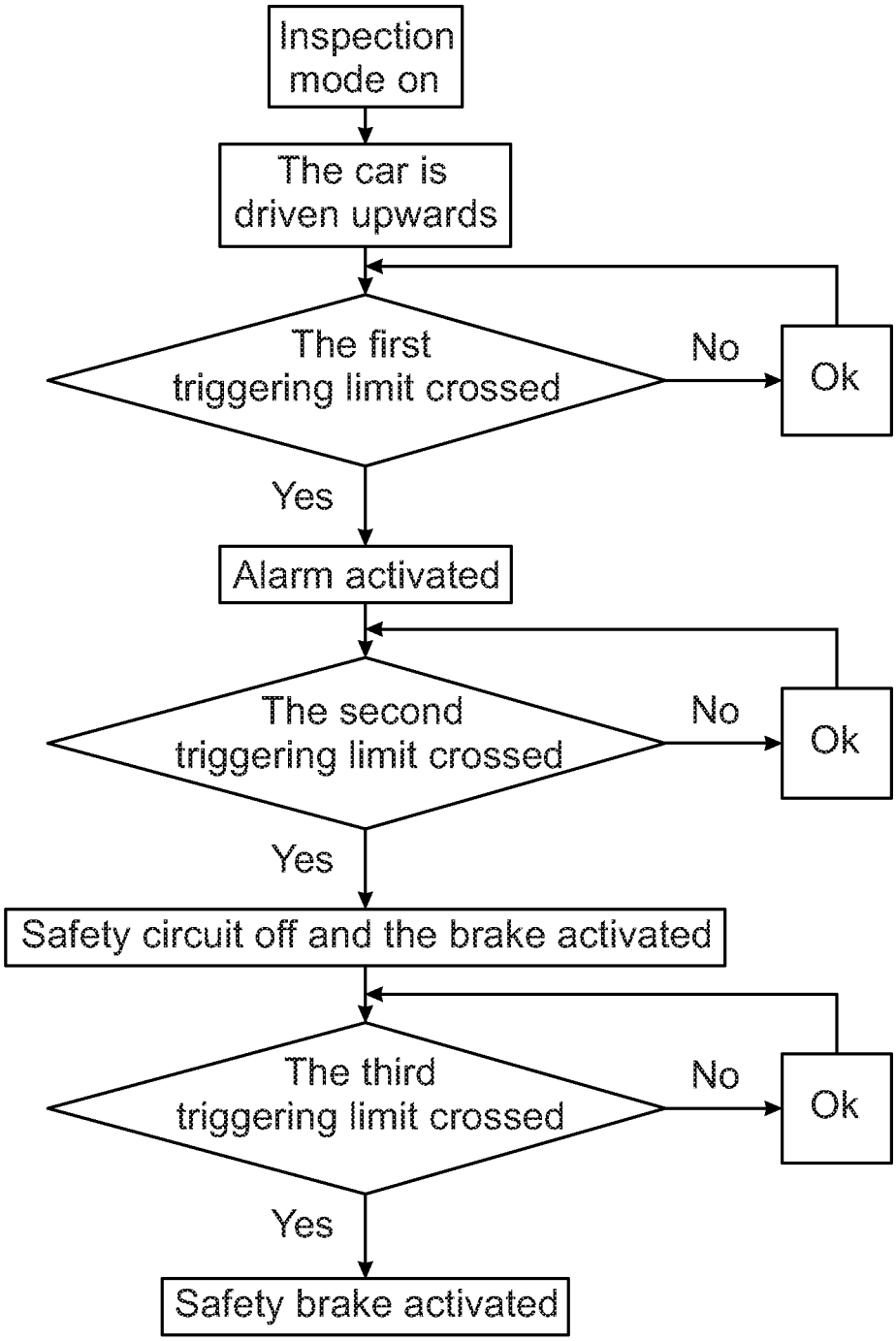

In the following, the invention will be described in detail by the aid of example embodiments by referring to the attached simplified and diagrammatic drawings, wherein FIG. 1 presents in a simplified and diagrammatic side view a part of the building where the back wall of the elevator shaft is removed, and an elevator in the elevator shaft, in which elevator the arrangement and method according to the invention can be used, FIG. 2 presents in a simplified and diagrammatic side view the upper part of the elevator shaft in the building according to FIG. 1, FIG. 3 presents in a simplified and diagrammatic side view another solution according to the invention, FIG. 4 presents in a simplified and diagrammatic block diagram mains parts of the safety arrangement according to the invention, and FIG. 5 presents in a simplified and diagrammatic flow chart the method according to the invention.

The main idea of the invention is to create a reliable and adequate safety space with pre-defined clearances CL1, CL2 CL3 at the upper part of an elevator shaft between the roof 5*a* of the elevator car 5 and the ceiling 2*a* of the elevator shaft 4. The safety space is created by progressively strengthening safety actions or operations based on the information about the need of the safety working space by using elevator car position data and either mechanical, electrical or logical means or any of their combinations.

FIG. 1 presents in a simplified and diagrammatic side view a part of the building 1 where the back wall of the elevator shaft 4 is removed, and an elevator in the elevator shaft 4, in which elevator the arrangement and method according to the invention can be used. The building 1 has a roof 2 just above the elevator shaft 4 and four floors 3 served by the elevator.

The elevator is a so-called Machine-Room-Less (MRL) elevator where the elevator machinery 8 with its operating brakes 8*b* and traction sheave 8*c* is in the elevator shaft 4 or in an appropriate space adjacent to the elevator shaft 4, and in the upper area of the elevator shaft, advantageously just below the ceiling 2*a* of the elevator shaft 4. In addition the elevator comprises among other things an elevator car 5 that is arranged to run up and down in the elevator shaft 4 along guide rails 7, and a counterweight 6 or balance weight that is also arranged to run up and down in the elevator shaft 4 along its guide rails which are not presented in FIG. 1 for the sake of clarity. The elevator car 5 and the counterweight 6 are connected to each other with elevator ropes or hoisting ropes that also are not presented in FIG. 1 for the sake of clarity. The cross section of the hoisting ropes can be round or as a flat rectangle. The elevator car 5 is also equipped with safety gear system 5*c* that is arranged to stop the movement of the elevator car 5 and to lock the elevator car 5 into the guide rails 7 when needed. If the safety gear system 5*c* used in this arrangement is in the elevator car 5 it is a bi-directional system. Whereas, if the safety gear system is installed in the counterweight 6, it can be unidirectional.

Each floor has a landing door 9 that is presented in FIG. 1 seen from the direction of the elevator shaft 4. In addition the elevator comprises at least an operating system, a control system 8*a*, an electrical system, a variety of sensors arrangements and a safety system.

FIG. 2 presents in a simplified and diagrammatic side view the upper part of the elevator shaft 4 in the building 1 according to FIG. 1. Also in this figure the back wall of the elevator shaft 4 is removed and the elevator shaft 4 is seen from its backside.

The safety arrangement according to the invention comprises two independent position sensor systems 11 and 12 to monitor the actual position of the elevator car 5 with respect to the ceiling 2*a* of the elevator shaft 4. The first position sensor system 11 comprises, for instance a laser measurement sensor 11*a* installed in the ceiling 2*a* of the elevator shaft 4. The laser measurement sensor 11*a* is arranged to measure the actual distance between the roof 5*a* of the elevator car 5 and the ceiling 2*a* of the elevator shaft 4.

The second position sensor system 12 comprises, for instance a series of inductive position measurement sensors 12*a* installed in the inner wall of the elevator shaft 4, and an appropriate counter sensor installed in the wall of the elevator car 5 so that when the elevator car is moving the counter sensor passes one by one each inductive position measurement sensor 12*a* whose location is known and thus the position of the elevator car and at the same time the distance between the roof 5*a* of the elevator car 5 and the ceiling 2*a* of the elevator shaft 4 can be determined.

The first and second position sensor systems 11, 12 can also comprise other kinds of distance or position measuring sensors, such as other optical or electrical sensors than laser sensors, or magnetic sensors or mechanical position sensors. The sensors of the position sensor systems 11, 12 are connected to the elevator operation system, to the elevator control system 8*a* and to the elevator safety system.

The elevator safety system according to the invention comprises three levels of safety operations in order to create an artificial pre-defined safety space zone 10 with an adequate clearance at the upper part of the elevator shaft 4 when the elevator is in an inspection or maintenance mode, later only the term inspection mode is used. Hereinafter the three levels of safety operations are called in a shorter way safety levels I, II and III. The safety operations here comprise at least one or more of the following operations: producing an alarm to stop the upwards-moving elevator car 5, switching off the electrical safety circuit, activating the operating brakes 8*b* of the elevator, activating the safety gear system 5*c* of the elevator.

The adequate clearance is the pre-defined distance CL1, CL2, CL3 between the roof 5*a* of the elevator car 5 and the ceiling 2*a* of the elevator shaft 4. In the safety level I the clearance CL1 is for example 4.0 m, in the safety level II the clearance CL2 is for example 3.0 m, and in the safety level III the clearance CL3 is for example 2.5 m. These measures can be varied depending of the elevator, but always the safety level I clearance CL1 is the longest distance and the safety level III clearance CL3 is the shortest distance. In the other words, the lower limit of the safety level I clearance CL1 or the first triggering limit L1 is at the lowest height, the lower limit of the safety level II clearance CL2 or the second triggering limit L2 is in the middle height and the lower limit of the safety level III clearance CL3 or the third triggering limit L3 is at the highest height.

The elevator safety system according to the invention comprises also an entry triggering system 13 that is arranged to inform the elevator when someone enters into the elevator shaft 4 outside the elevator car 5. In that case usually someone steps inside the elevator shaft 4 through one of the landing doors 9. FIG. 2 presents an entry triggering system 13 with a trigger sensor 13*a* inside the elevator shaft 4 close to each landing door 9. When the landing door 9 is opened manually, for example from a floor 3 the trigger sensor 13*a* is arranged to send a signal to the elevator safety system which is further arranged to set the elevator to the inspection mode.

FIG. 3 presents another entry triggering system 13 that is arranged to inform the elevator when someone steps onto the roof 5*a* of the elevator car 5. This entry triggering system 13 comprises a trigger sensor 13*b* that is installed between a moving plate 14 and the roof 5*a* of the elevator car 5. The moving plate 14 is installed to move up and down on the roof 5*a* of the elevator car 5 and is supported by springs 15 so that the cap between the moving plate 14 and the roof 5*a* of the elevator car 5 is such that the trigger sensor 13*b* remains non-activated. When someone steps onto the moving plate 14 the plate 14 moves downwards towards the spring force and at the same time activates the trigger sensor 13*b*. In that case the trigger sensor 13*b* is arranged to send a signal to the elevator safety system, which is further arranged to set the elevator to the inspection mode. The activation of the inspection mode can also be arranged so that there is a button for the activation of the inspection mode on the roof 5*a* of the elevator car 5, and when the trigger sensor 13*b* has been activated by the load of a person on the plate 14 the elevator car 5 does not move before the button for the activation of the inspection mode is pressed.

In the inspection mode the elevator car 5 can be driven manually using for instance an appropriate inspection drive controller on the roof 5*a* of the elevator car 5. The entry triggering system 13 also comprises an appropriate electronic logic control system that is arranged to initiate the safety action when the landing door 9 is opened or someone has stepped onto the moving plate 14.

FIG. 4 presents in a simplified and diagrammatic block diagram main parts of the safety arrangement according to the invention. The elevator comprises a variety of sensors, such as the two independent position sensor systems 11 and 12 with their position sensors 11*a* and 12*a* in the elevator shaft 4, and the entry triggering system 13 with its sensors 13*a* or 13*b* that also are in the elevator shaft 4, and other appropriate sensors in appropriate places. All the sensors in the safety system are connected to the elevator control system 8*a* through a receiving means 16 that is arranged to receive the data from the sensor systems 11, 12, 13, and to forward the received data further to a data processing means of the elevator control system 8*a*. The data processing means 17 is arranged to process the data received and to activate an activating means 17 for the safety level I if the monitored position of the elevator car 5 crosses the first triggering limit L1 or the lower limit of the safety level I clearance CL1, and to activate an activating means 18 for the safety level II if the position of the elevator car 5 crosses the second triggering limit L2 or the lower limit of the safety level II clearance CL2, and to activate an activating means 19 for the safety level III if the position of the elevator car 5 crosses the third triggering limit L3 or the lower limit of the safety level III clearance CL3. The triggering limit L1, L2, L3 or the lower limit of each clearance CL1, CL2 or CL3 is the same as the maximum height where the elevator car 5 can be in each safety level I, II or III. Crossing the triggering limit L1, L2 or L3 means that the elevator car 5 is aiming to drive higher than is allowed on each safety level I, II or III.

The activating means 17 for the safety level I is connected, for example to activate an alarm device 5*b* that is situated for instance on the roof 5*a* of the elevator car 5. The alarm device 5*b* can be for instance a buzzer, a blinking light a loudspeaker, or another appropriate device. It can also be in another place in the elevator shaft 4 than on the roof 5*a* of the elevator car 5. The purpose of the alarm is to inform the person on the roof 5*a* of the elevator car 5 that the elevator car 5 is driving too high and has to be stopped by the person.

The activating means 18 for the safety level II is connected, for example to activate the electrical safety circuit of the elevator and to activate the operating brakes 8*b* of the elevator machinery 8. The activating means 18 for the safety level II can also be connected to another kind of a braking system to stop the upwards movement of the elevator car 5.

Whereas the activating means 19 for the safety level III is connected, for example to activate the safety gear system 5*c* of the elevator to stop the upwards movement of the elevator car 5 and to lock the elevator car 5 into the guide rails 7. In the safety level III the elevator car 5 is arranged to keep firmly in its place so that at least the minimum required safety distance between the roof 5*a* of the elevator car 5 and the ceiling 2*a* of the elevator shaft 4 is maintained in all conditions.

The safety levels I, II and III and their functions are arranged to be used only when the elevator is in the inspection mode. The safety level I is activated automatically when the elevator is set to the inspection mode. In that case when the elevator car 5 is driven upwards with the inspection drive and the position of the elevator car 5 is continuously measured by the two independent position sensor systems 11 and 12, the elevator control system 8*a* is arranged to monitor the movement of the elevator car 5, and to stop the movement of the elevator car 5 in a progressively strengthening way in the three safety levels I, II and III if the elevator car 5 is aiming to drive too high in the elevator shaft 4 when someone is on the roof 5*a* of the elevator car 5. The progressively strengthening way mentioned above means that the upwards movement of the elevator car 5 is stopped, when the elevator is in the inspection or maintenance mode, with actions which are arranged to become more and more effective and definitive safety level by safety level. In that case there is only a warning message on the first safety level I, the activation of the safety circuit and the operation brakes 8*b* of the elevator on the second safety level II, and the activation of the safety gear system 5*c* on the third safety level III.

FIG. 5 presents in a simplified and diagrammatic flow chart a method according to the invention. Only main steps of the method are presented in FIG. 5. The method according to the invention for creating a safe working space in the upper part of the elevator shaft 4 has at least the steps as follows:

an artificial safety space zone 10 with three safety levels I, II and III is created at the upper end of the elevator shaft 4 and the minimum safety clearances CL1, CL2 and CL3 for each safety level I, II and III are defined with two independent position sensor systems 11, 12 to monitor the crossing of triggering limits L1, L2, L3 or the lower limits of the safety clearances CL1, CL2 and CL3, an entry into the elevator shaft 4 is monitored with the sensors 13*a* of the entry triggering system 13, or stepping onto the roof 5*a* of the elevator car 5 monitored with the sensors 13*b* of the entry triggering system 13, if someone is detected by the entry triggering system 13 of entering into the elevator shaft 4 through a landing door 9 or detected of stepping onto the roof 5*a* of the elevator car 5, the detection information is sent to the elevator control system 8*a* and the elevator is set to the inspection mode where the elevator car 5 can be driven using an inspection drive controller on the roof 5*a* of the elevator car 5, or the elevator car 5 is kept firmly in its place without a possibility to drive the car 5 until the appropriate inspection mode button on the roof 5*a* of the elevator car 5 is pressed, The inspection mode is now on and the elevator car 5 can be driven using the inspection drive controller on the roof 5*a* of the elevator car 5.

When the elevator car 5 is driven upwards using the inspection drive controller on the roof 5*a* of the elevator car 5 the steps of the method according to the invention continues as follows:

the movement and the position of the elevator car 5 is monitored by the two independent position sensor systems 11 and 12, if the monitored position of the elevator car 5 crosses the first triggering limit L1, the crossing is detected by the position sensor systems 11 and 12, and the detected information is sent to the elevator control system 8*a*, and an alarm is activated through an appropriate alarm device 5*b*. In this case the upwards movement of the elevator car 5 can be manually stopped by the person on the roof 5*a* of the elevator car 5, the movement and the position of the elevator car 5 is continuously monitored by the two independent position sensor systems 11 and 12, if for some reason the alarm did not work or alarm is ignored, and the monitored position of the elevator car 5 crosses the second triggering limit L2, the detected information is sent to the elevator control system 8*a*, and the electrical safety circuit of the elevator is activated to switch off the power of the elevator motor, and the operating brakes 8*b* of the elevator machinery 8 are activated to stop the upwards movement of the elevator car 5, the movement and the position of the elevator car 5 is continuously monitored by the two independent position sensor systems 11 and 12, if the car 5 still tends to move upwards, and the monitored position of the elevator car 5 crosses the third triggering limit L3, the detected information is sent to the elevator control system 8*a*, and the safety gear system 5*c* of the elevator is activated to stop the upwards movement of the elevator car 5 and to lock the elevator car 5 into the guide rails 7, in the safety level III the elevator car 5 is kept firmly in its place so that at least the minimum required safety distance between the roof 5*a* of the elevator car 5 and the ceiling 2*a* of the elevator shaft 4 is maintained in all conditions.

It is essential to the arrangement and method according to the invention that when someone has entered into the elevator shaft 4 through a landing door 9, or—in certain solutions—when someone has stepped onto the roof 5*a* of the elevator car 5, the attendance is detected and informed to the elevator control system 8*a* that is arranged to activate the pre-defined safety space zone 10 at the upper part of the elevator shaft 4 using a number of different safety levels, for instance, three safety levels I, II and III where the efficiency to stop the movement of the elevator car 5 increases from the safety level I to the safety level III.

It is obvious to the person skilled in the art that the invention is not restricted to the examples described above but that it may be varied within the scope of the claims presented below. Thus, for instance the order of the method steps may differ from the order presented in the claims, or method steps may be more or less than presented in the claims.

It is also obvious to the person skilled in the art that the sensor and monitoring systems can be different from what is presented above.

The invention claimed is:

1. An elevator with a safety arrangement for creating a safe working space in an upper part of an elevator shaft, the elevator comprising:

an elevator car configured to move in the elevator shaft along a plurality of guide rails;

a counterweight connected to the elevator car;

an instance of hoisting machinery in the upper part of the elevator shaft, the instance of hoisting machinery including a plurality of operating brakes; and an elevator control system configured to monitor a position of the elevator car in the elevator shaft in relation to a plurality of safety levels in the elevator shaft, each safety level associated with a separate clearance of the elevator car from a ceiling of the elevator shaft, and control the elevator, based on the elevator being in an inspection mode or maintenance mode, to create a safety space zone at the upper part of the elevator shaft, the controlling including performing progressively strengthening safety operations in response to the elevator car progressively moving upwards through separate triggering limits of separate clearances associated with separate safety levels of the plurality of safety levels, the performing progressively strengthening safety operations including performing a first safety operation to activate an alarm device to prompt manual stopping of the elevator car in response to a determination that the elevator car has moved upwards through a first triggering limit at a lower edge of a first clearance of the elevator car from the ceiling of the elevator shaft, the first clearance associated with a first safety level of the plurality of safety levels, and performing a second safety operation to activate a braking system that is configured to arrest upwards movement of the elevator car through the elevator shaft in response to a determination that the elevator car has moved upwards through a second triggering limit at a lower edge of a second clearance of the elevator car from the ceiling of the elevator shaft, the second clearance associated with a second safety level of the plurality of safety levels, wherein a magnitude of the first clearance is greater than a magnitude of the second clearance.

2. The elevator according to claim 1, wherein the plurality of safety levels includes the first safety level, the second safety level, and a third safety level, the third safety level is associated with a third clearance of the elevator car from the ceiling of the elevator shaft, a third triggering limit of the third clearance being at a lower edge of the third clearance, and the magnitude of the second clearance is greater than a magnitude of the third clearance.

3. The elevator according to claim 2, wherein each clearance of the elevator car from the ceiling of the elevator shaft is associated with a separate minimum distance between a roof of the elevator car and the ceiling of the elevator shaft.

4. The elevator according to claim 1, further comprising:

two independent sensor systems, each independent sensor system configured to generate sensor data indicating an actual position of the elevator car with respect to the ceiling of the elevator shaft, wherein the elevator control system is configured to monitor the position of the elevator car in the elevator shaft in relation to the plurality of safety levels in the elevator shaft based on processing the sensor data generated by the two independent sensor systems.

5. The elevator according to claim 1, wherein the performing the second safety operation to activate the braking system includes activating both a safety circuit of the elevator and the plurality of operating brakes of the instance of hoisting machinery in response to the determination that the elevator car has moved upwards through the second triggering limit at the lower edge of the second clearance.

6. The elevator according to claim 2, wherein the performing progressively strengthening safety operations includes performing a third safety operation to activate a safety gear system of the elevator in response to a determination that the elevator car has moved upwards through the third triggering limit at the lower edge of the third clearance.

7. A method for creating a safe working space in an upper part of an elevator shaft of an elevator, the elevator further including an elevator car configured to move in the elevator shaft along a plurality of guide rails, the method comprising:

monitoring a position of the elevator car in the elevator shaft in relation to a plurality of safety levels in the elevator shaft, each safety level associated with a separate clearance of the elevator car from a ceiling of the elevator shaft; and controlling the elevator, based on the elevator being in an inspection mode or maintenance mode, to create a safety space zone at the upper part of the elevator shaft, the controlling including performing progressively strengthening safety operations in response to the elevator car progressively moving upwards through separate triggering limits of separate clearances associated with separate safety levels of the plurality of safety levels, the performing progressively strengthening safety operations including performing a first safety operation to activate an alarm device to prompt manual stopping of the elevator car in response to a determination that the elevator car has moved upwards through a first triggering limit at a lower edge of a first clearance of the elevator car from the ceiling of the elevator shaft, the first clearance associated with a first safety level of the plurality of safety levels, and performing a second safety operation to activate a braking system that is configured to arrest upwards movement of the elevator car through the elevator shaft in response to a determination that the elevator car has moved upwards through a second triggering limit at a lower edge of a second clearance of the elevator car from the ceiling of the elevator shaft, the second clearance associated with a second safety level of the plurality of safety levels, wherein a magnitude of the first clearance is greater than a magnitude of the second clearance.

8. The method according to claim 7, wherein the plurality of safety levels includes the first safety level, the second safety level, and a third safety level, the third safety level is associated with a third clearance of the elevator car from the ceiling of the elevator shaft, a third triggering limit of the third clearance being at a lower edge of the third clearance, and the magnitude of the second clearance is greater than a magnitude of the third clearance.

9. The method according to claim 7, wherein the controlling the elevator to create the safety space zone is in response to a determination that an entry triggering system of the elevator is triggered in response to an individual entering the elevator shaft, and the monitoring includes processing sensor data generated by two independent position sensor systems to determine an actual position of the elevator car with respect to the ceiling of the elevator shaft.

10. The method according to claim 8, wherein the monitoring continuously monitors movement of the elevator car and the position of the elevator car based on continuously processing sensor data generated by two independent position sensor systems, and the performing progressively strengthening safety operations includes performing the second safety operation to activate a safety circuit of the elevator and activating operation brakes of elevator machinery of the elevator to stop the elevator car in response to the determination that the elevator car has moved upwards through the second triggering limit at the lower edge of the second clearance, and performing a third safety operation to activate a safety gear system of the elevator to stop the elevator car and to lock the elevator car into the guide rails in response to a determination that the elevator car has moved upwards through the third triggering limit at the lower edge of the third clearance.

* * * * *